US011725310B2

(12) United States Patent
Rose et al.

(10) Patent No.: US 11,725,310 B2
(45) Date of Patent: Aug. 15, 2023

(54) INSULATING DOUBLE-KNIT FABRIC

(71) Applicant: MMI-IPCO, LLC, Andover, MA (US)

(72) Inventors: William Michael Rose, East Hampstead, NH (US); Gary S. Smith, Lee, NH (US); Marina Kozera, Charlotte, NC (US); William Patz, Belmont, NC (US); Gadalia Vainer, Melrose, MA (US)

(73) Assignee: MMI-IPCO, LLC, Spartanburg, SC (US)

( * ) Notice: Subject to any disclaimer, the term of this patent is extended or adjusted under 35 U.S.C. 154(b) by 1195 days.

(21) Appl. No.: 16/130,657

(22) Filed: Sep. 13, 2018

(65) Prior Publication Data

US 2019/0078241 A1 Mar. 14, 2019

Related U.S. Application Data

(60) Provisional application No. 62/692,012, filed on Jun. 29, 2018, provisional application No. 62/557,950, filed on Sep. 13, 2017.

(51) Int. Cl.

| | |
|---|---|
| ***D04B 1/24*** | (2006.01) |
| ***D04B 1/16*** | (2006.01) |
| ***D03D 11/02*** | (2006.01) |
| ***D03D 25/00*** | (2006.01) |
| ***A41D 31/06*** | (2019.01) |

(52) U.S. Cl.

CPC ..... *D03D 11/02* (2013.01); *A41D 31/06* (2019.02); *A41D 31/065* (2019.02); *D03D 25/005* (2013.01); *D04B 1/16* (2013.01); *D04B 1/24* (2013.01); *A41D 2400/10* (2013.01); *A41D 2500/10* (2013.01); *D10B 2401/04* (2013.01); *D10B 2403/0222* (2013.01); *D10B 2403/0243* (2013.01); *D10B 2403/033* (2013.01); *Y10T 442/45* (2015.04); *Y10T 442/456* (2015.04)

(58) Field of Classification Search

CPC ..... D04B 1/16

See application file for complete search history.

(56) References Cited

U.S. PATENT DOCUMENTS 2,401,830 A * 6/1946 Kahil ..... D03D 11/00 428/152
2,921,456 A 1/1960 Evans
5,569,233 A 10/1996 Goulait
(Continued)

OTHER PUBLICATIONS

Patent Cooperation Treaty PCT International Search Report, dated Nov. 21, 2018. International Application No. PCT/US2018/050890. International Filing Date: Sep. 13, 2018.

(Continued)

*Primary Examiner* — Jenna L Johnson

(74) *Attorney, Agent, or Firm* — Cheryl J. Brickey

(57) ABSTRACT

An improved insulating performance fabric has a double-knit body, formed with traditional, relatively smooth, outer surfaces, and an inner surface with the form of multiple fabric "bubbles" separated, e.g., by a grid pattern of intersecting grooves. An insulating, double-knit performance fabric of this disclosure may also be found in the form of a garment comprising the insulating, double knit performance fabric, or in the form of fabric article comprising the insulating, double knit performance fabric, etc.

14 Claims, 12 Drawing Sheets

(56) References Cited

U.S. PATENT DOCUMENTS

| | | | | |
|---|---|---|---|---|
| 5,787,503 | A * | 8/1998 | Murphy, III | A41D 1/04 66/196 |
| 6,156,406 | A | 12/2000 | Rock et al. | |
| 6,277,469 | B1 | 8/2001 | Wildeman | |
| 6,779,368 | B2 | 8/2004 | Rock et al. | |
| 6,828,003 | B2 | 12/2004 | Rock et al. | |
| 7,217,456 | B1 | 5/2007 | Rock et al. | |
| 7,380,421 | B1 | 6/2008 | Liu | |
| 7,579,045 | B2 | 8/2009 | Rock et al. | |
| RE41,574 | E | 8/2010 | Rock et al. | |
| 7,776,421 | B2 | 8/2010 | Rock et al. | |
| 7,829,172 | B2 | 11/2010 | Rock et al. | |
| 8,129,296 | B2 | 3/2012 | Rock et al. | |
| 8,298,645 | B2 | 10/2012 | Rock et al. | |
| 10,130,129 | B2 | 11/2018 | Rock et al. | |
| 2005/0287894 | A1 | 12/2005 | Burns et al. | |
| 2011/0117353 | A1* | 5/2011 | Henshaw | D02G 3/443 428/221 |
| 2011/0177294 | A1* | 7/2011 | Rock | B32B 5/026 428/166 |
| 2012/0260422 | A1* | 10/2012 | Rock | A47G 9/0223 5/483 |
| 2014/0087104 | A1 | 3/2014 | Kierderle et al. | |
| 2015/0104604 | A1 | 4/2015 | Rock et al. | |
| 2018/0179678 | A1 | 6/2018 | Dorton | |

OTHER PUBLICATIONS

Patent Cooperation Treaty PCT Written Opinion, dated Nov. 21, 2018. International Application No. PCT/US2018/050890. International Filing Date: Sep. 13, 2018.

International Search Report and Written Opinion; PCT/US18/50890; dated Nov. 21, 2018; 22 pages.

* cited by examiner

INSULATING DOUBLE-KNIT FABRIC

The present application claims priority to U.S. Provisional Application No. 62/557,950 filed Sep. 13, 2017, entitled "Power Air Insulating Fabric," and to U.S. Provisional Application No. 62/692,012 filed Jun. 29, 2018, entitled "Power Air Insulating Fabric," the entireties of which applications are hereby incorporated herein by reference.

TECHNICAL FIELD

This invention relates to fabrics, and, more particularly, to insulating performance fabrics, e.g. for wearing apparel, and the like.

BACKGROUND

Performance fabrics manufactured for use in insulating garments often include fleece fabric, i.e. fabric having a raised or brushed fiber surface for improved insulation performance. The surface of such fabrics is often formed of fleece, which is raised, i.e. given relatively higher loft, by mechanical brushing. It has, however, been recognized that the brushing process can often result in broken fibers, which, over time, can work loose, potentially resulting in microfiber pollution. Loss of fibers, e.g., during washing, can also result in deterioration of insulation performance. Further, it is recognized that broken fibers released during washing can get into wastewater, causing pollution.

SUMMARY

Improved insulating performance fabrics have a knit, e.g., a double-knit, body, formed with a traditional, relatively smooth, outer surface, and an inner gridded surface with the form of multiple fabric "bubbles" separated by a grid pattern of intersecting grooves. Insulating performance fabrics, including double-knit fabrics of this disclosure, may also be found in the form, e.g., of garments comprising POLARTEC™ Power Air™performance fabrics, including insulating, double-knit fabrics, e.g., in the form of fabric articles comprising POLARTEC™ Power Air™ fabrics, formed, e.g., of insulating, double-knit fabric, etc.

In one aspect of the disclosure, an insulating, double-knit performance fabric includes a first knit layer, a second knit layer coupled with the first knit layer, and a plurality of intermediate fiber regions. The intermediate fiber regions contain a plurality of fibers and positioned between the first knit layer and the second knit layer. The plurality of intermediate fiber regions are positioned in a plurality of air pockets formed by at least one of the first knit layer and the second knit layer.

In certain implementations, the insulating, double-knit performance fabric includes one or more of the following additional features. The plurality of intermediate fiber regions may include a plurality of regions of lofted fibers. The lofted fibers may be un-napped, un-brushed and/or are not mechanically lifted. The lofted fibers may be encapsulated in the plurality of air pockets loose. The lofted fibers can extend in a direction having an orthogonal component with respect to the at least one of the first knit layer and the second knit layer. The lofted fibers may be substantially parallel to first knit layer and the second knit layer. The lofted fibers may be randomly positioned. The lofted fibers may include microfibers. The plurality of regions of lofted fibers may be spaced apart from one another. When the plurality of regions of lofted fibers are spaced apart from one another this may be achieved via a plurality of spaced rows separating them. The insulating, double-knit performance fabric element can include at least one braided tube positioned in and extending along at least a portion of at least one space row in the plurality of spaced rows separating the plurality of regions of lofted fibers from one another. The braided tube comprises a monofilament composed, at least in part, of a material that is distinct from the plurality of fibers of the intermediate fiber. The first knit layer and the second knit layer comprise a denier gradient such that the first knit layer has a relatively finer denier than the second knit layer or the second knit layer has a relatively finer denier than the first knit layer. Each of the first knit layer and the second knit layer may have a relatively finer denier than the plurality of intermediate fiber regions. At least one of the first knit layer and the second knit layer may form a smooth surface. At least one of the first knit layer and the second knit layer may define a plurality of windows. The plurality of windows can be positioned over respective spaces of a plurality of spaces separating the intermediate fiber regions from one another. The plurality of intermediate fiber regions may be arranged in a gridded pattern. The plurality of intermediate fiber regions may be arranged in a plurality of rows. In some implementations, each of the intermediate fiber regions include a plurality of rows of fibers extending parallel to the at least one of the first knit layer and the second knit layer. The plurality of fibers of the intermediate fiber regions can include a low melt fiber. The plurality of fibers of the intermediate fiber regions can include at least one of a bi-component filament, a polyester blend, and a polyamide. The bi-component filament can include modacrylic fiber and cellulosic fiber. In some implementations, each of the first knit layer and the second knit layer comprise the air pockets include the plurality of intermediate fiber regions. The first knit layer and the second knit layer may include a circular knit. The first knit layer and the second knit layer can include a double raschel knit. The plurality of intermediate fiber regions can include a plurality of densities of lofted fibers. The intermediate fiber regions in the plurality of intermediate fiber regions that are adjacent a stitch coupling the first knit layer to the second knit layer can have a lower density than intermediate fiber regions in the plurality of intermediate fiber regions that are not adjacent to a stitch coupling the first knit layer to the second knit layer.

In another aspect of the disclosure, a garment comprising an insulating, double-knit performance fabric as described according to an implementation disclosed herein is provided.

One aspect of the disclosure provides a method of manufacturing an insulating, double-knit performance fabric. The method includes knitting a first layer, knitting a second layer, and positioning and/or attaching a plurality of fibers to at least one of the first layer and the second layer. The plurality of fibers positioned and/or attached as a plurality of separated fiber regions. The method includes encapsulating the plurality of separated fiber regions into a plurality of spaced apart air pockets. The method includes attaching the first layer and the second layer together so as to position the spaced apart air pockets encapsulating the plurality of separated fiber regions between the first layer and the second layer.

In certain implementations, the method of manufacturing an insulating, double-knit performance fabric includes one or more of the following processes. The method can include positioning a braided tube in a space between the air pockets encapsulating the plurality of separated fiber regions and between the first layer and the second layer. The method can include exposing the braided tube to heat to fuse a filament forming the braided tube together inside the space. The method can include forming a plurality of windows in at least one of the first layer and the second layer and positioning the plurality of windows over and between the pluralities of air pockets encapsulating the plurality of separated fiber regions.

One aspect of the disclosure provides a method of manufacturing an insulating, double-knit performance fabric disclosed herein.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

The invention of the present disclosure, shown, e.g., in FIGS. 1-4, provides a synthetic material that opens new worlds of design possibilities in this important industry. In particular, over the past half century, the process of developing performance fabrics has continued to evolve and reshape. In this same time span, our knowledge and understanding of how these synthetic materials can potentially have adverse impact on the environment has continued to grow. What's more, we have also begun to learn more about how, over time, many of these synthetic products continue to break down and shed small particulates, such as microfibers. There is, however, a way to change how synthetic fibers are designed, and thereby to reduce their longer term, undesirable impact.

Figure 1:
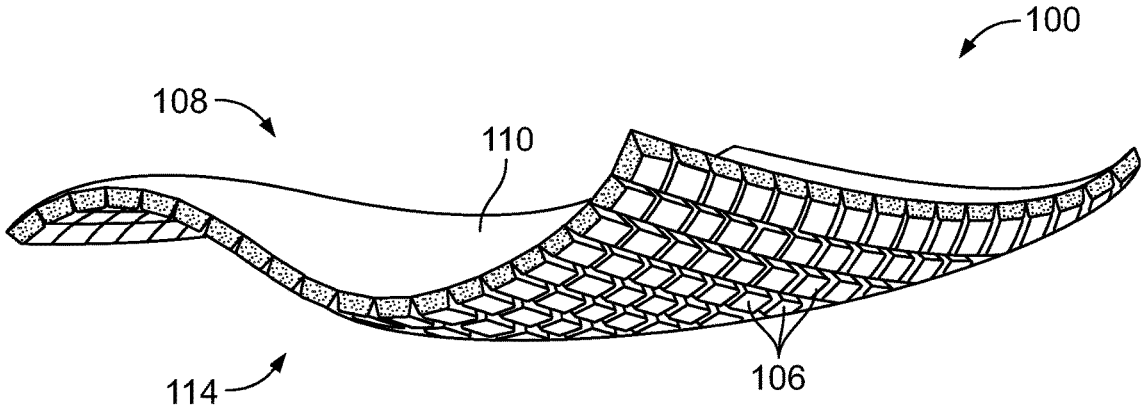
FIG. 1 is a perspective view of a first (upper) element of a POLARTEC™ Power Air™ fabric of this disclosure.
Figure 2:
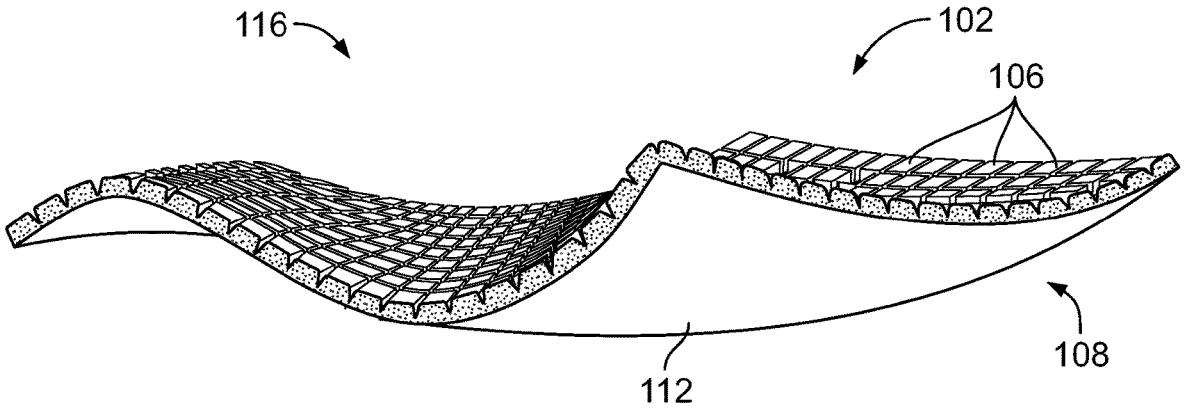
FIG. 2 is a perspective view of a second (lower) element of a POLARTEC™ Power Air™ fabric of this disclosure.
Figure 3:
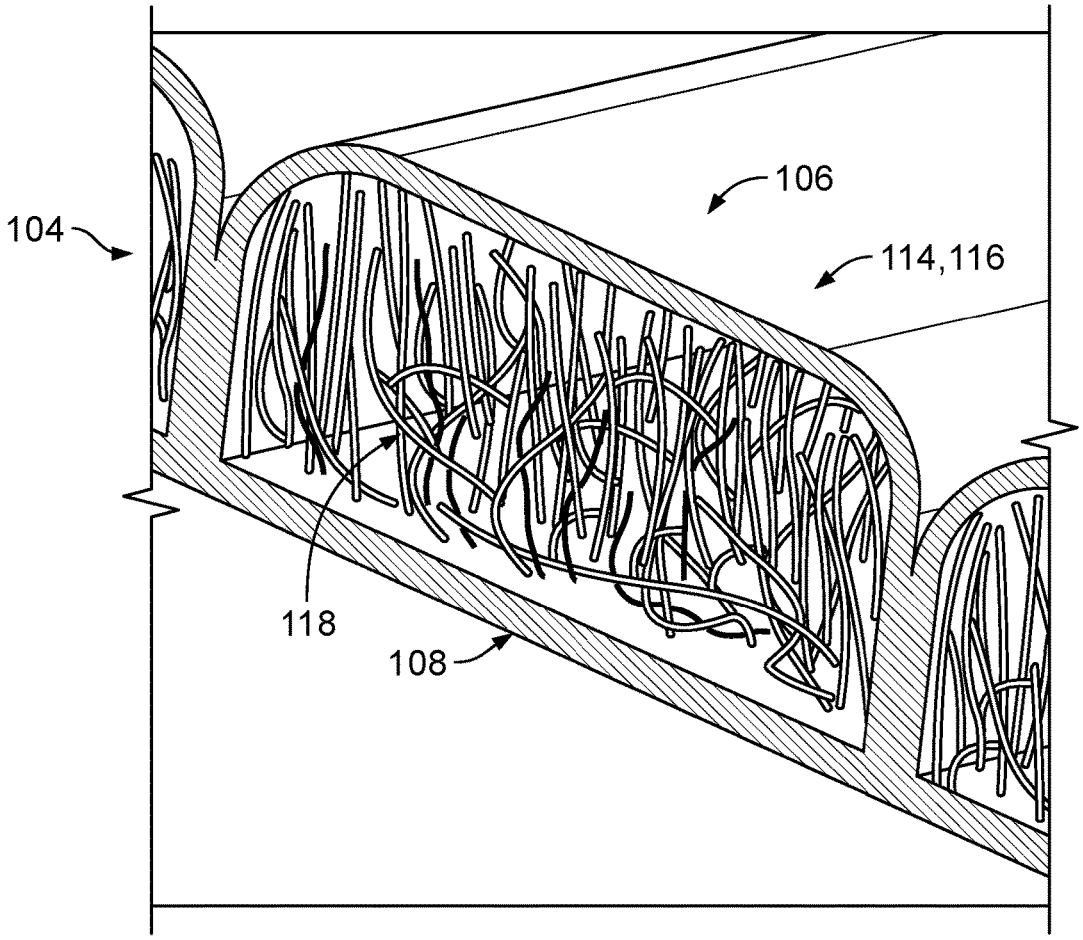
FIG. 3 is a perspective view of a POLARTEC™ Power Air™ fabric of this disclosure.
Figure 4:
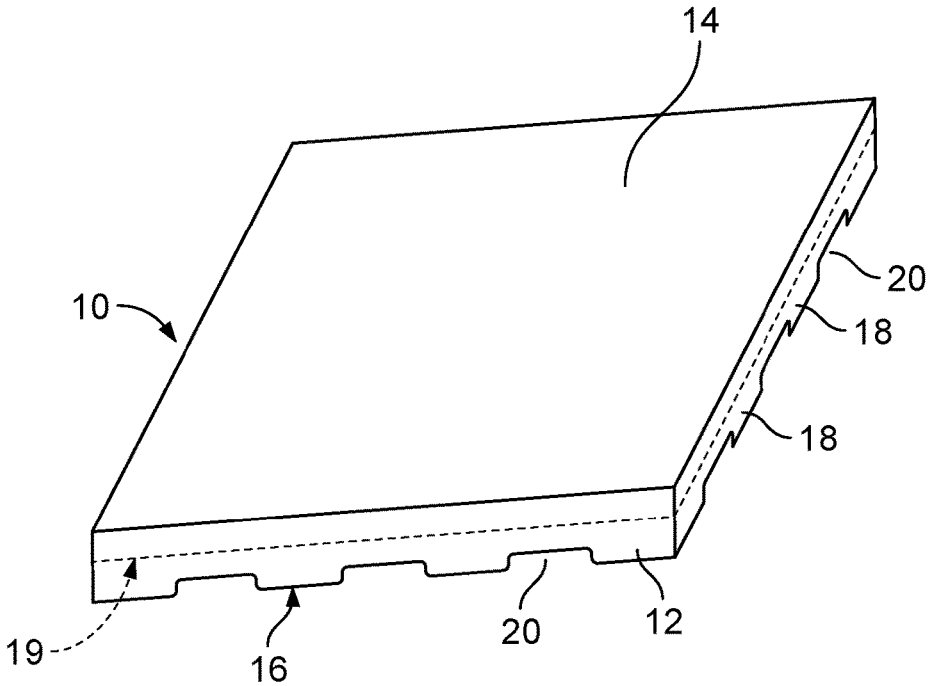
FIG. 4 is a perspective view of another embodiment of a POLARTEC™ Power Air™ fabric of this disclosure.

In response, this application introduces POLARTECυ Power Airπ synthetic fabric material 100 (see, e.g. FIGS. 1-3), a revolutionary fabric that reduces microfiber shedding without sacrificing desirable warmth-to-weight ratios. In one particular embodiment, POLARTECπ Power Airπ synthetic fabric material is a single fabric structure knit into multiple components. For example, referring to FIGS. 1-3, each of components 100, 102 encapsulates air around lofted fibers 118, thereby to contain body heat in the manner of traditional insulation. FIG. 3 shows an enlarged view 104 of the air pockets 106. The lofted fibers 118 are encapsulated via the knit structure of the fabric material 100. In particular implementations, the regions of encapsulation are more densely knitted to trap the lofted fibers. The dense knitting is more dense on both the flat side as well as on the bubble side of the encapsulated region, in particular implementations. However, in an exemplary embodiment of the POLARTECπ Power Airπ synthetic fabric material, these loftier fibers 118 are no longer exposed to outside elements or abrasive surfaces. Rather, these loftier fibers 118 are secured inside each of the air pockets 106. The result is a fabric 100 that has proven to shed 5×(i.e. five times) less microfibers than standard fleece in laboratory tests. Furthermore, the advantages of the POLARTECπ Power Airπ fabric design of the present invention do not stop at microfiber retention, as its exposed smooth face 108 reduces friction for less pilling, greater durability and easier layering with other fabrics.

In addition, the fabric platform of the POLARTEC™ Power Air™ fabric product creates entirely new categories of performance knits. These performance knits are designed to provide a wearer with relatively more warmth, and less shedding of microfibers, thereby giving any outerwear application of the POLARTEC™ Power Air™ fabric products even wider design versatility, and with a negative impact (i.e. undesirable shedding of microfibers) that has been reduced more than ever before. POLARTEC™ Power Air™ fabric products thus hold "more than just heat".

In one embodiment, the opposite exterior surfaces 110, 112 of the POLARTEC™ Power Air™ fabric 100 are smooth and soft, while the respective opposed surfaces 114, 116 of the interior construction have the form of a symmetrical grid pattern of air pockets 106, which are found to provide enhanced encapsulation of fibers and microfibers. In certain embodiments, the grid pattern of air pockets may include spaces between the air pockets 106. The POLARTEC™ Power Air™ fabric 100 is thus recognized as "holding more than just heat," and provides a number of particular features and advantages. These include, for example, high warmth-to-weight ratio. They also include shedding of 5 times (i.e., "5×") less microfibers, e.g., as compared to fleece fabrics of similar utility and/or insulation performance. The POLARTEC™ Power Air™ fabric is also versatile in a range of design applications, including with smooth (outer) faces 110, 112 for easy layering. The disclosed fabrics, in preferred embodiments, also exhibit, e.g., lasting durability, resistance to pilling, and/or high breathability.

Also, by engineering a way to markedly enhance encapsulation of synthetic lofted microfibers 118, POLARTEC™ Power Air™ fabrics are changing how insulating fabrics will perform over their lifetimes or how the insulating fabrics will retain their performance and thereby increase their longevity. This new fabric construction thus encases lofted fibers 118 within self-contained air pockets 106. In certain implementations, the lofted fibers 118 are positioned in the air pocket randomly and/or are floating within the air pocket.

The air pockets 106 capture and release warm air, while gaining added strength and support from the surrounding knit structure. The structure 106 also serves as a barrier, which prevents loose microfibers from shedding into the environment. The two distinctly contrasting surfaces 106 and 112 of the POLARTEC™ Power Air™ fabric 100 provide markedly wider design versatility, e.g., as compared to most other insulation fabrics. Finally, the symmetrical grid interior 114, 116 holds warmth, while the opposite smooth surfaces 110, 112 reduce surface drag, thereby to reduce or prevent pilling, and to allow easy layering with other materials.

The components 100 and 102 are stitched together in accordance with particular implementations. The components 100 and 102 are stitched together in a manner that reduces and/or avoids stitching within the inlay (i.e. the air pockets 106 containing the lofted fibers 118) to prevent the lofted fibers 118 from being trapped or causing them to protrude through the exterior surfaces 110, 112. In certain implementations, the air pockets 106 along the edge of the fabric or adjacent to stitching are provided with less lofted fibers 118 than other air pockets away from an edge or not adjacent to stitching securing the components 100 and 102 together to reduce and/or eliminate trapping of lofted fibers and thereby prevent and/or reduce lofted fibers from protruding through the exterior surfaces 110, 112.

For example, referring again to FIGS. 4-9, a further representative POLARTEC™ Power Air™ fabric product 10 is shown having horizontal positioning (in the main view), with air pockets 20 (seen at a macro level). The air pockets 20 provide encapsulation of lofted fibers, and thermal retention, with filtered microfibers (e.g., with approximately 5 times (i.e., "5×") less shedding of undesirable microfibers, e.g. as compared to the shedding of microfibers by of comparable prior art fabric products). Furthermore, the fabric of the present invention typically has two distinct surfaces, including a symmetrical gridded interior 16 and a smooth outer surface 14.

In use, a representative POLARTEC™ Power Air™ fabric product is well suited for use in cold weather conditions and activities, such as outdoor training, mountain trekking, in urban environments, and is base installations, etc. In can also reduce, or even make unnecessary, the putting on and removing of layers, i.e., as often necessary for maintaining comfort, e.g. in changing conditions and/or during varying degrees of exertion.

Figure 5:
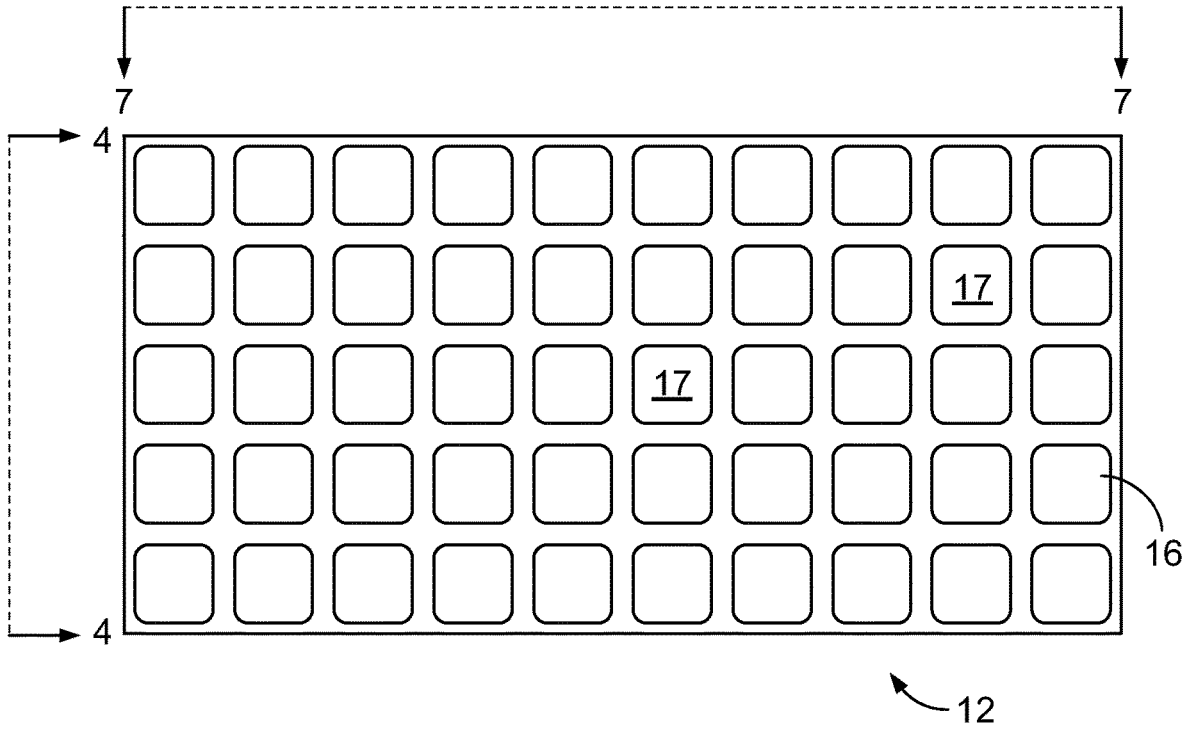
FIG. 5 is a plan view of the POLARTEC™ Power Air™ fabric of FIG. 4.
Figure 6:
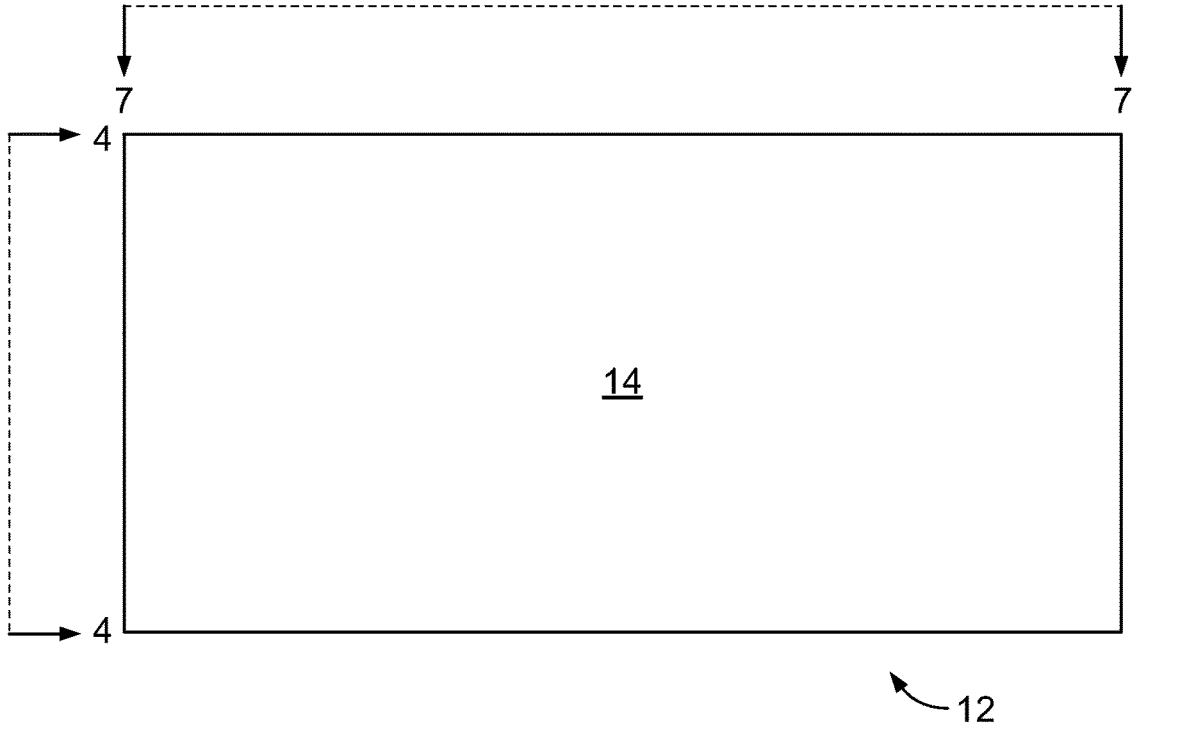
FIG. 6 is similar plan view of the POLARTEC™ Power Air™ fabric of FIG. 4.
Figure 7:
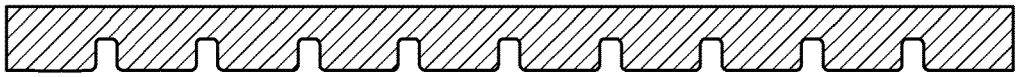
FIG. 7 is a first side view of the POLARTEC™ Power Air™ fabric of FIG. 4.
Figure 8:
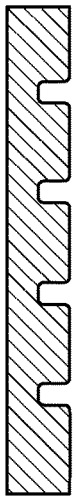
FIG. 8 is a second side view of the POLARTEC™ Power Air™ fabric of FIG. 4.
Figure 9:
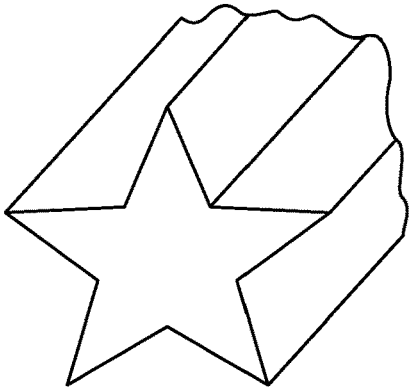
FIG. 9 is an example of a yarn of the POLARTEC™ Power Air™ fabric of FIG. 4

The improved, POLARTECπ Power Airπ insulating fabric 10 has a double-knit body 12, formed with a first, traditional, relatively smooth outside surface 14 and relatively high loft, grid (or gridded) inside surface 16. POLARTECπ Power Airπ insulating fabric 10 is a double (weft) knit fabric designed in such a way as to create a composite, three-layer construction, including, but not limited to, relatively flat, smooth outer "face" surfaces 14, an outer "backside" surface 16 with generally hemispherical or somewhat irregular geometric-like raised areas 18 (FIG. 4), and a middle layer 19 (FIG. 4), which consists of multifilament fibers contained between the two outer surface regions 14, 16. FIGS. 5 and 6 show the same orientations 4 and 7.

The double-knit "bubbles" 18 and air spaces 20 of the inside surface 16 of the POLARTEC™ Power Air™ fabric 10 provide an insulating air space equivalent to traditional brushed grid fabric. However, the POLARTEC™ Power Air™ insulating, double-knit fabric is manufactured without a brushing step, which can at least diminish the breaking of fibers, to eliminate (or at least reduce) microfiber pollution, and also to reduce fiber loss in washing, with resultant corresponding reduction in insulation performance. The result is reduction, or elimination, of fiber pollution in wastewater from washing. Additionally, there is a significant reduction in the production of waste fibers during manufacturing with the elimination of mechanical lifting via brushing or knapping.

The design and construction of the improved POLARTEC™ Power Air™ double-knit fabric 10 of the disclosure replaces the middle layer of a brushed grid fabric.

The POLARTEC™ Power Air™ fabric, provided in different gradients, in order to encourage advantageous movement of moisture through the body of the fabric, or the insulating fabric, may be formed of polypropylene yarns (recognized as a good water carrier, i.e., polypropylene does not hold moisture), or yarns of these or other materials, alone or in blend(s), may also be employed.

In some embodiments, the outer surface of at least some yarns forming the fabric POLARTECπ Power Airπ insulating, double-knit fabric may define channels, e.g. the yarn has a star-shape outer surface contour (see FIG. 9), to encourage/permit moisture movement, where desired.

Figure 10:
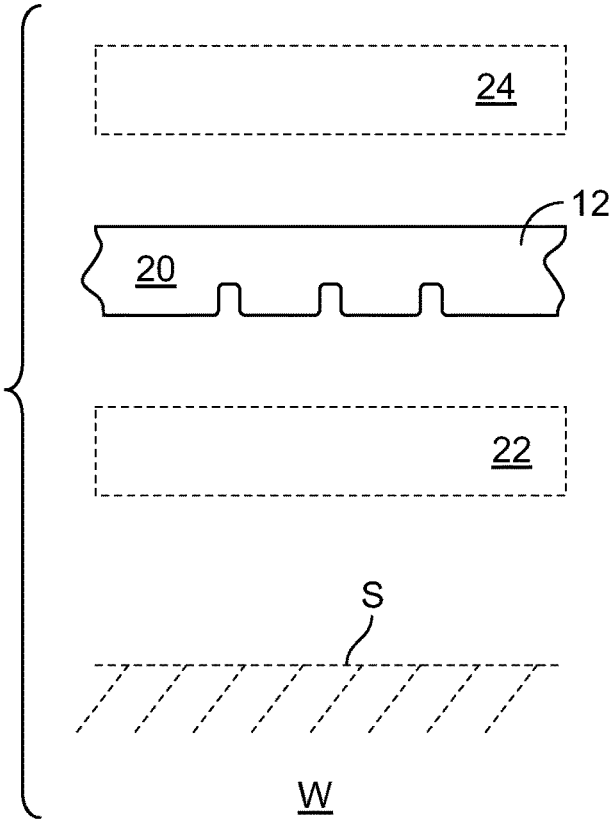
FIG. 10 is a somewhat schematic side plan view of the POLARTEC™ Power Air™ fabric of FIG. 4.

The POLARTEC™ Power Air™ insulating, double-knit fabric may be used, e.g., in insulating outdoor performance apparel to provide a significantly reduced propensity to shed microfibers during the life of the garment, while providing optimum comfort for the wearer. The processing of this fabric excludes the use of mechanical brushing or napping devices to increase insulation value of the material for use in outdoor apparel. Referring to FIG. 10, in one representative embodiment, the POLARTEC™ Power Air™ insulating, double-knit fabric 12 is formed into a garment 20, e.g. a shirt, which, for comfort in chilly or inclement weather, could be worn as a mid-layer, in combination with and between a light weight t-shirt or undershirt 22, worn against the wearer's skin, S, and an outer, windbreaker-type jacket 24 worn on over the POLARTEC™ Power Air™ insulating, double-knit fabric garment.

Other performance features incorporated into the POLARTECπ Power Airπ insulating double-knit fabric include: thermal insulating properties (measured as Clo value) achieved by using fibers types and cross-sections that optimize thermal insulation efficiency with minimal added fabric weight. Also, moisture migration properties and fabric moisture retention are managed in a manner to maximize comfort by utilization of fibers with cross-sections that promote accelerated dry times and moisture vapor transport rate. In particular embodiment, the lofted fibers can be formed (e.g. geometrically or materially) to have a particular gradient (e.g., denier) that causes moisture to flow in a particular direction. In addition, pockets of air that add insulation value and air movement (measured as air permeability) for moisture management are created through the integration of alternating raised surfaces 18 (FIG. 4) with the intersection of back and face layers. Also, fiber coatings comprised of polyurethane polymers are incorporated to promote fabric durability (measured as "Martindale abrasion/pilling rating"). Finally, fiber treatments comprised of silicon emulsions are incorporated to modify fiber orientation within the raised fabric structure and increase air volume, in certain implementations.

The POLARTEC™ Power Air fabrics thus provide multiple desired qualities that may be described and summarized, for example, as one or more of: "Warm more. Shed Less"; "Air Powered Design"; "Holds More Than Heat"; "It's Time to Get Knit-Picky"; "Want to catch more than just Air?"; "Harness Your Heat"; "Put Some Power in Your Insulation"; "Regulate Heat. Reduce Impact"; "The Power of Air", etc.

As shown in the examples of FIGS. 11A-13D, the PowerAir™ fabric can include various versions of the dual-surface double-knit construction with various air encapsulation configurations.

Figure 11A:
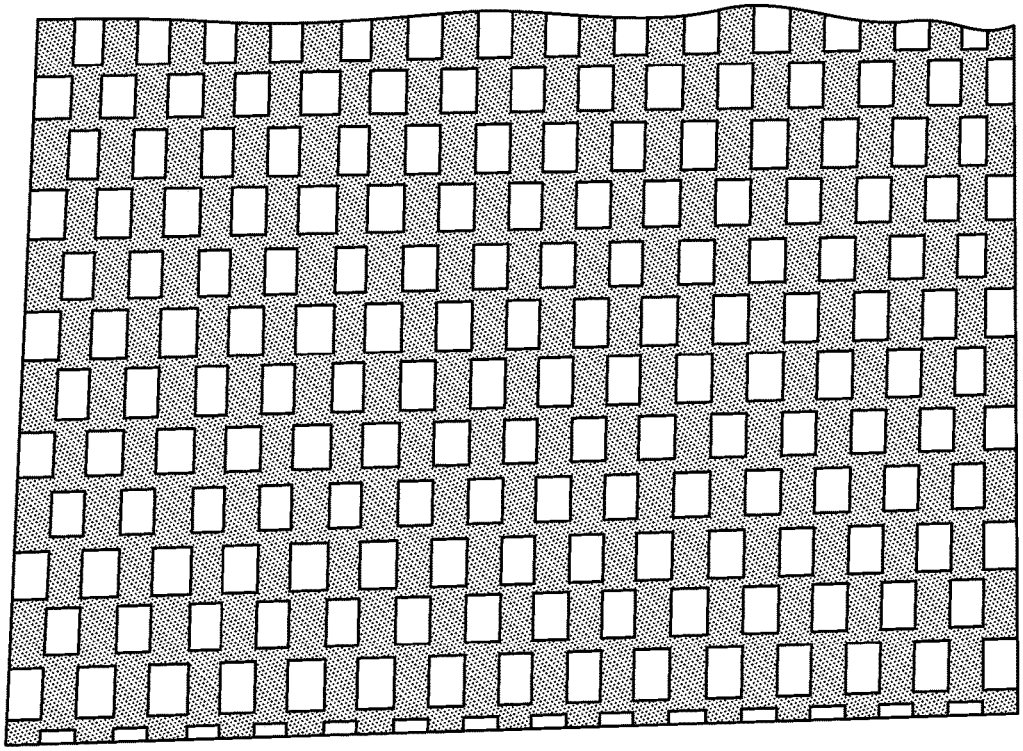
FIGS. 11A-11E show an embodiment of the POLARTEC™ Power Air™ fabric with windows and an inlay and formed with circular knit.
Figure 11B:
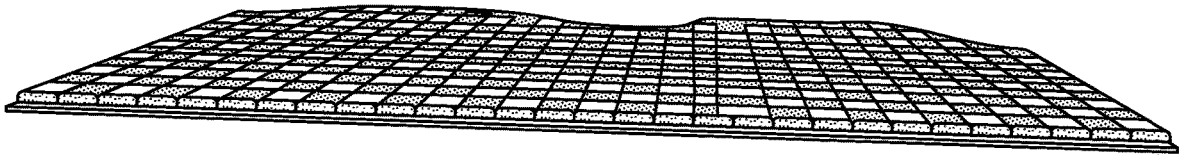
Figure 11C:
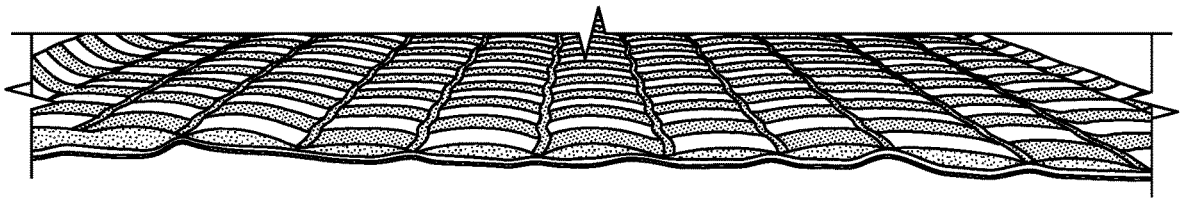
Figure 11D:
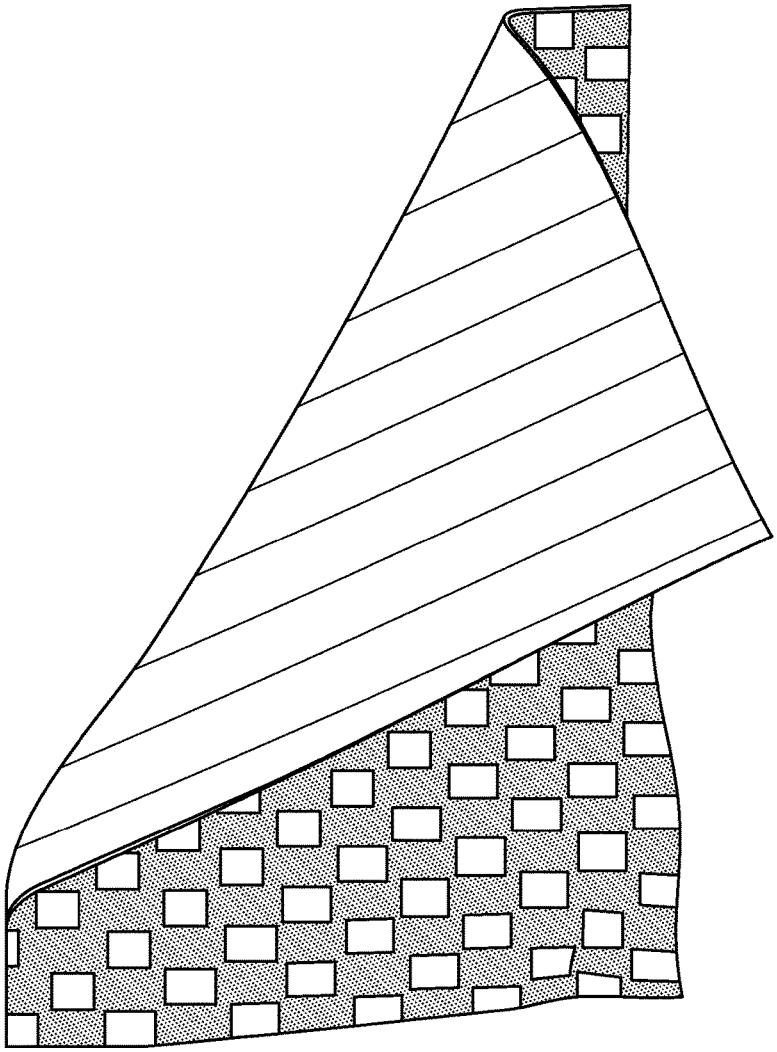
Figure 11E:
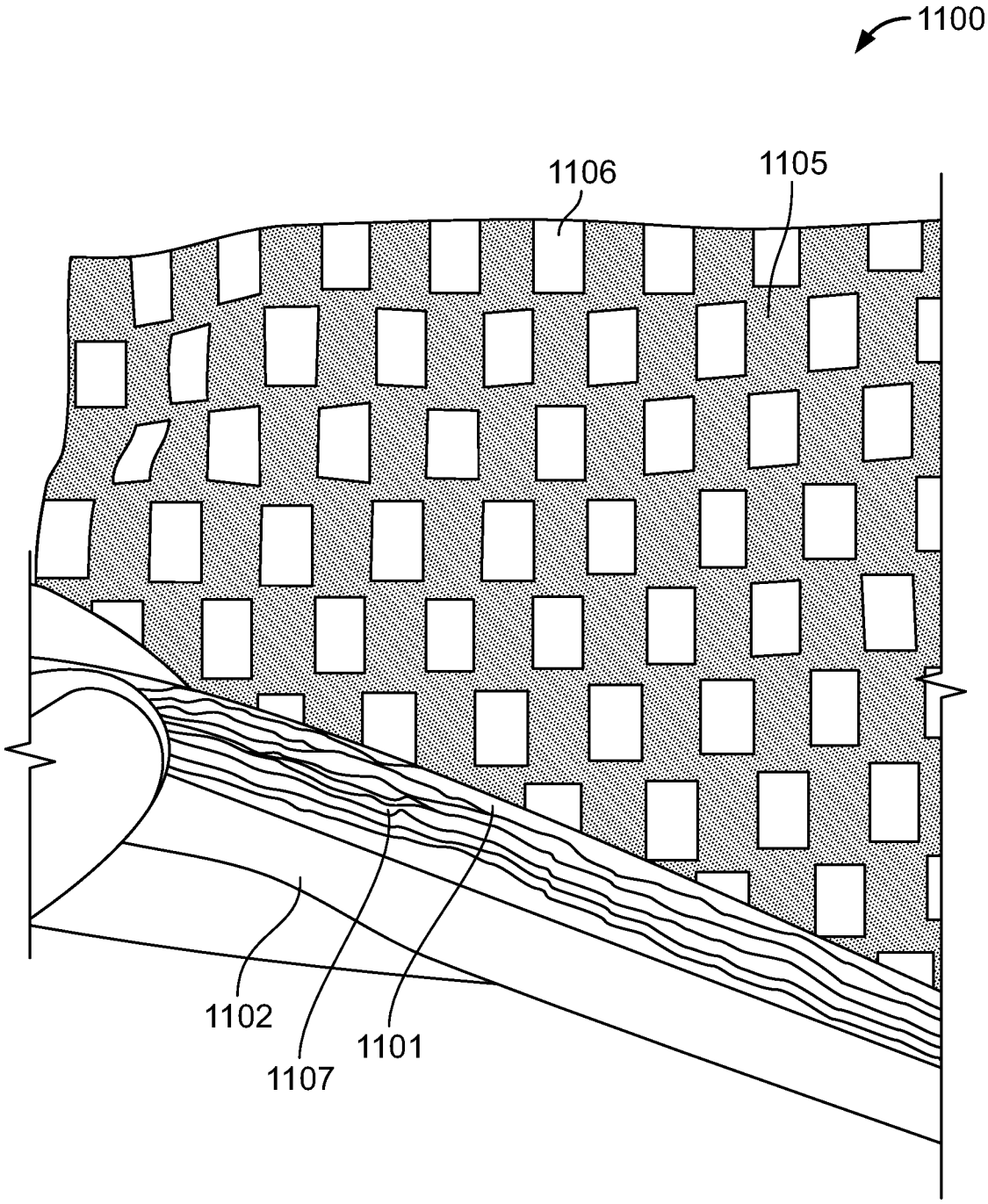

FIGS. 11A-11E show an implementation of POLARTECπ Power Air fabric with windows and an inlay formed into the circular knit construction. An inlayed fabric 1100 is illustrated in FIGS. 11A-11E. The inlayed fabric 1100 includes a plurality of windows 1106 and non-windows 1105 formed in an outer layer 1101 of the fabric 1100. The inner layer 1102, in contrast, does not include window inlays 1106. The outer layer 1101 and the inner layer 1102 form a plurality of rows or channels as shown in FIGS. 11C and 11D. The rows form elongated air pockets housing intermediate fiber regions 1103 housing fibers 1107 positioned substantially parallel to the inner layer 1102 and the outer layer 1101. In certain implementations, the fibers 1107 are floating within the channels 1101. The outer knit layer 1101 is formed as a circular knit and the inner knit layer 1102 is formed as a circular knit.

Figure 12A:
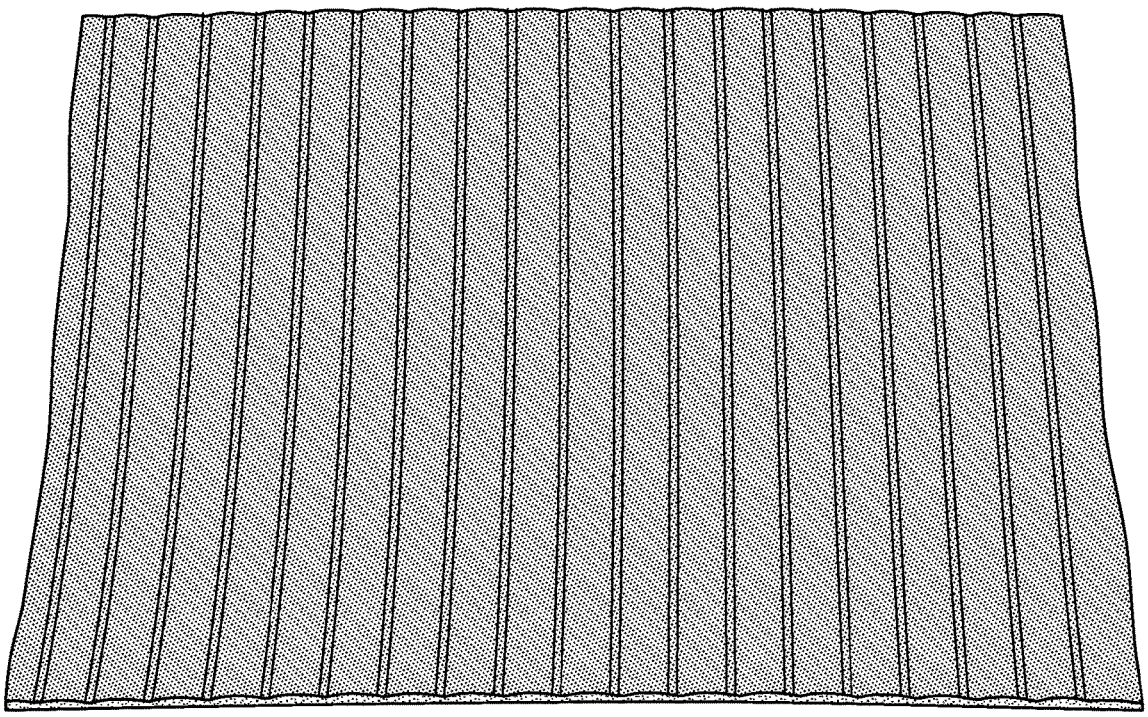
FIGS. 12A-12G illustrate embodiments of the POLARTEC™ Power Air™ fabric with a solid back and face and formed with double raschel.
Figure 12B:
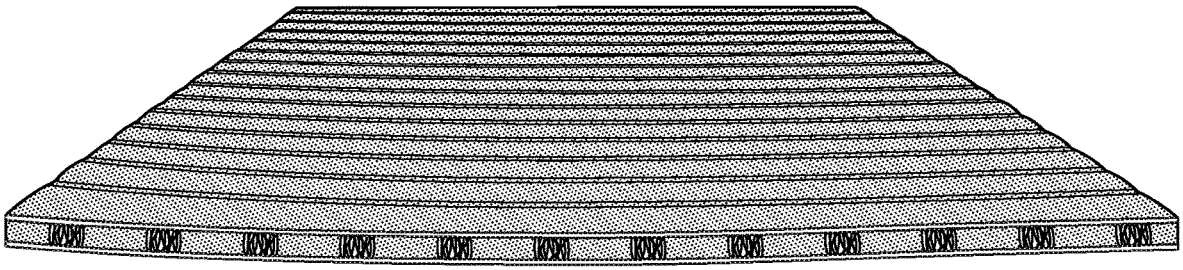
Figure 12C:
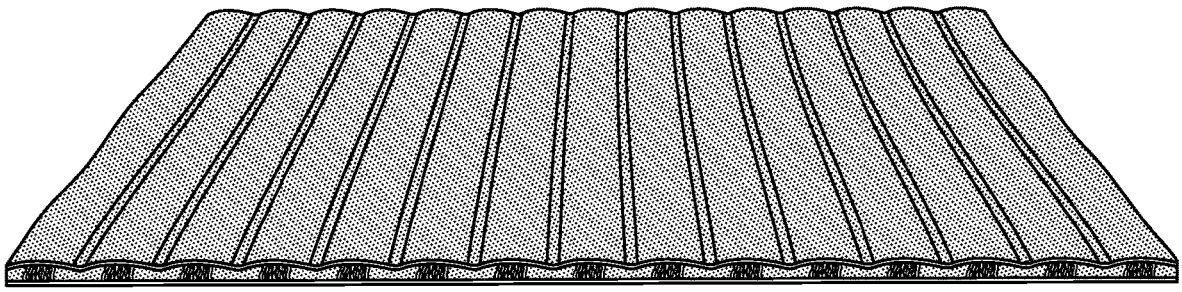
Figure 12D:
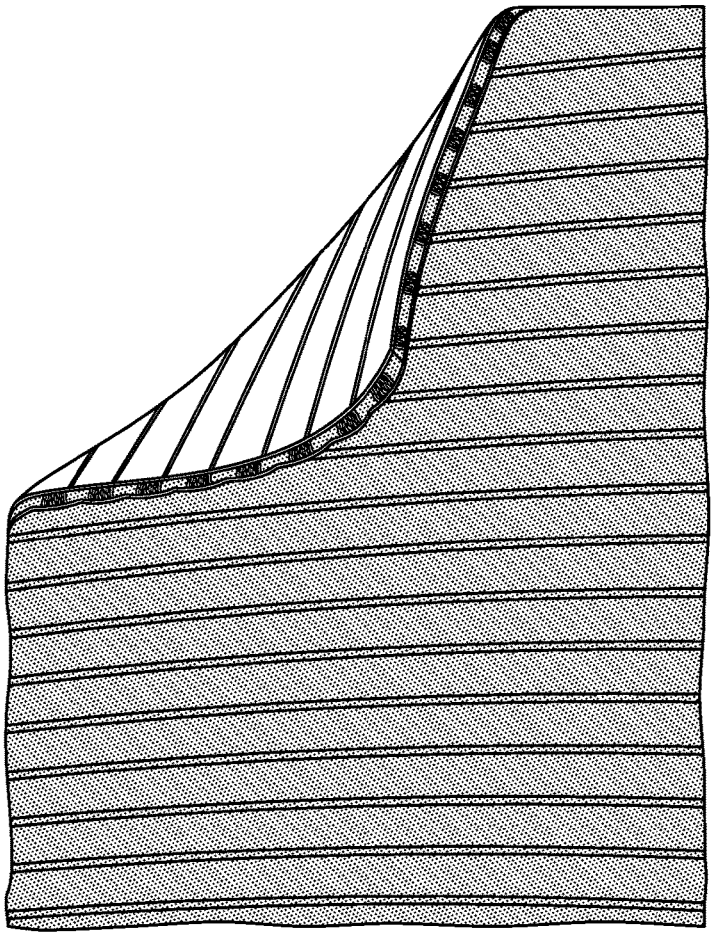
Figure 12E:
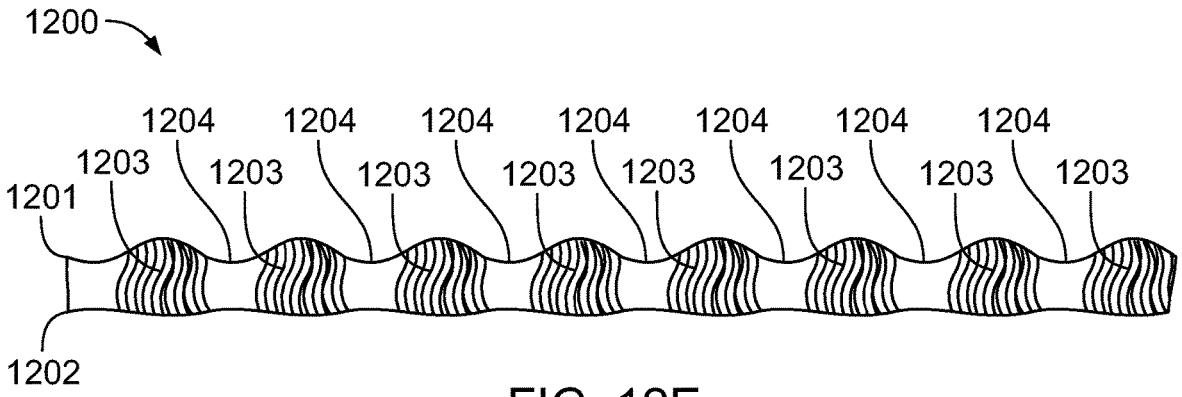
Figure 12F:
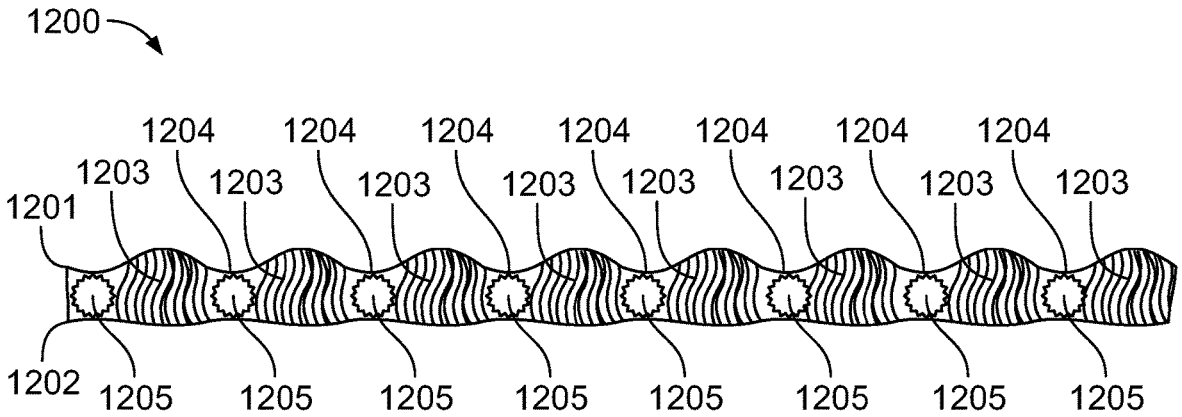
Figure 12G:
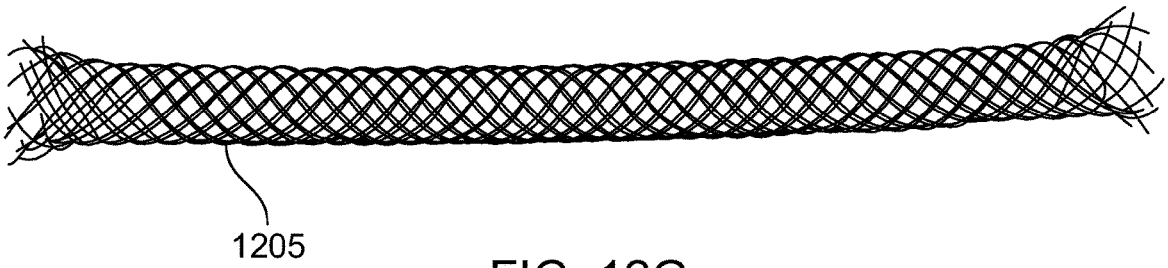
Figure 13A:
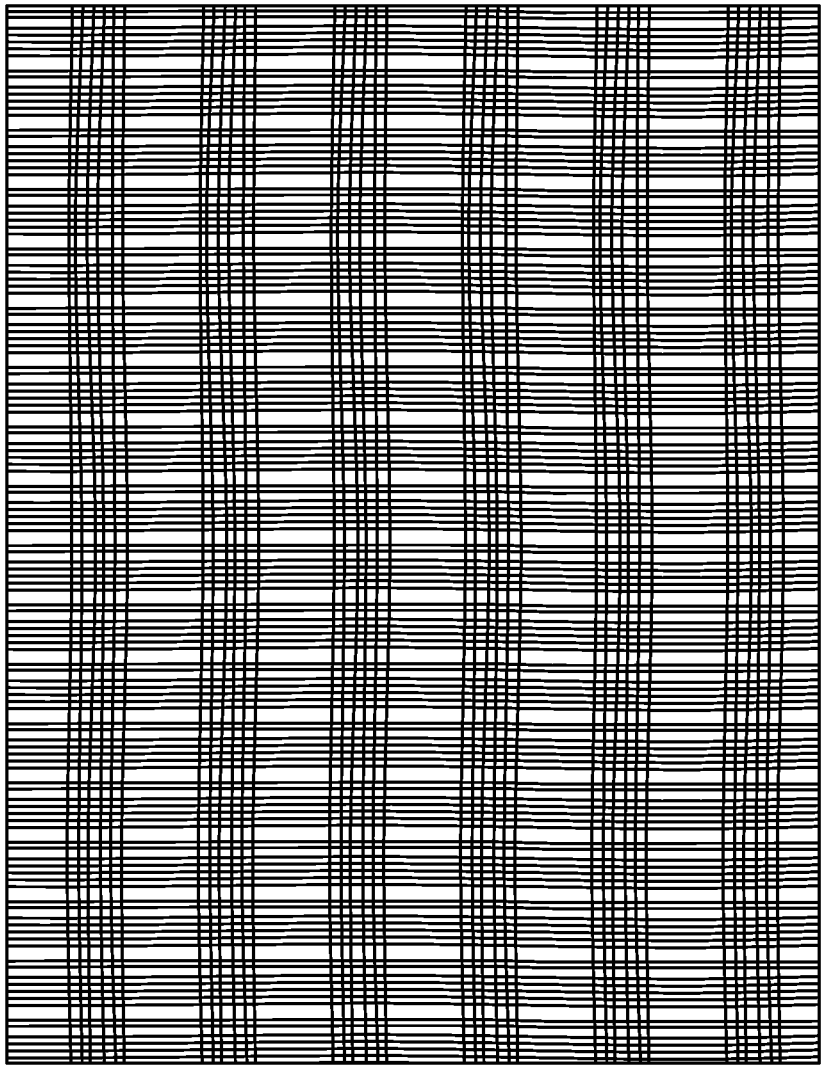
FIGS. 13A-13D illustrate an embodiment of the POLARTEC™ Power Air™ fabric with a solid back and an open face and formed with double raschel.
Figure 13B:
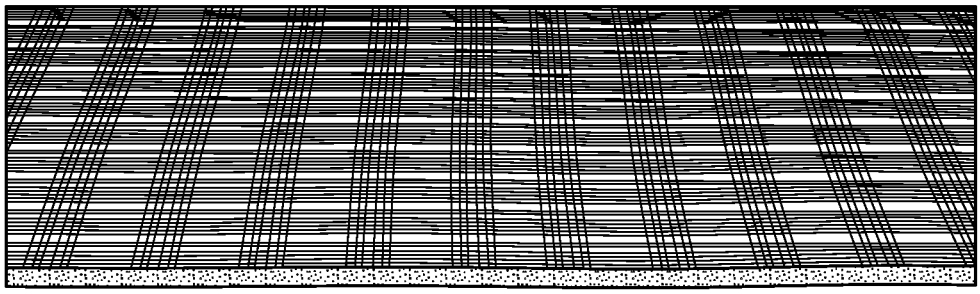
Figure 13C:
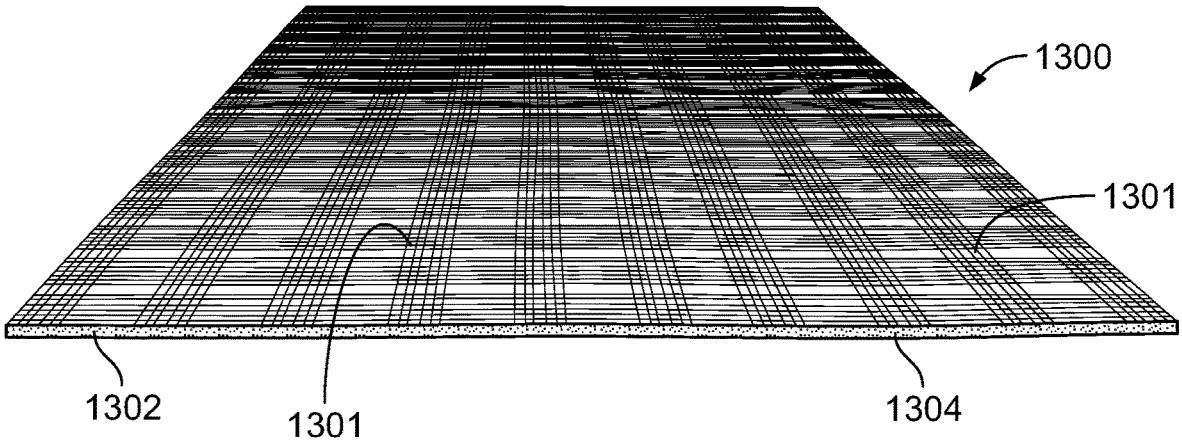
Figure 13D:
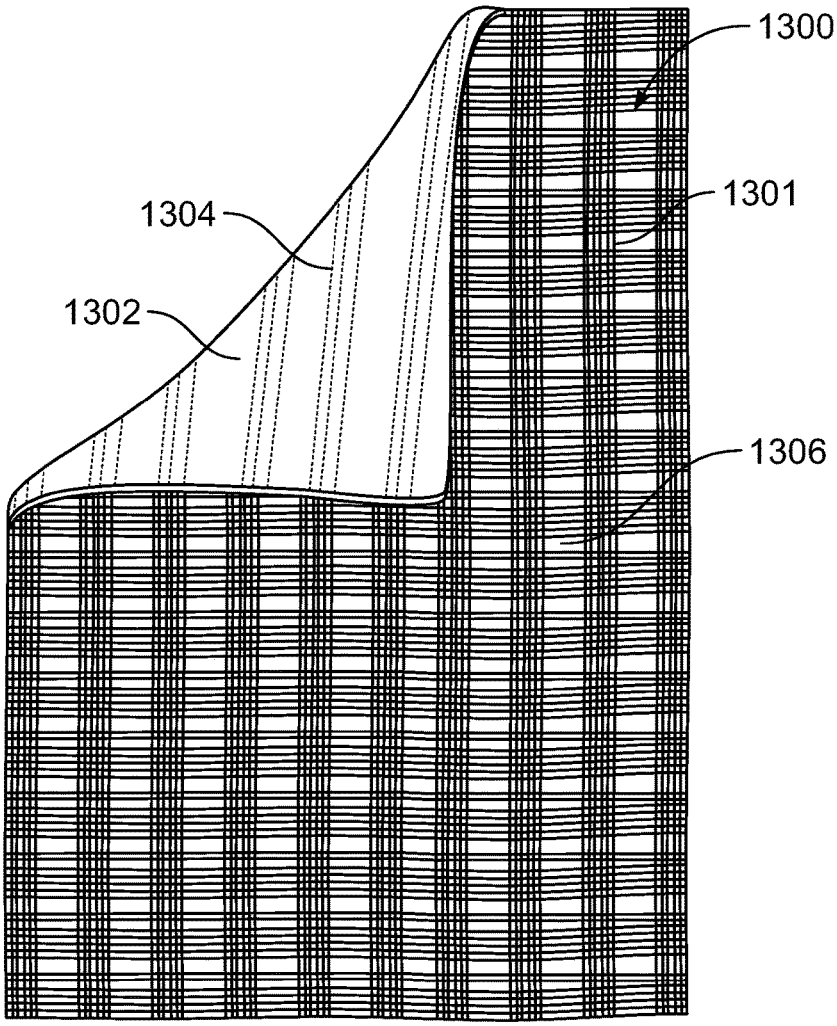

FIGS. 12A-12G illustrate POLARTECπ Power Airπ fabric with a solid back and face and formed with a double raschel. A double raschel fabric 1200 is shown in FIGS. 12A-12G. The double raschel fabric 1200 has a solid knit layer 1201 as well as a solid knit layer 1202. The solid knit layer 1201 and solid knit layer 1202 may be composed of various materials that can include, but are not limited to, polyester, polypropylene, nylon, wool, cellulosic fibers, flame resistant fibers, modacrylic fibers, polyamide fibers or other natural or synthetic fibers in whole or in part, blended or unblended. The solid knit layers 1201 and 1202 encapsulate a plurality of regions of lofted fibers 1203 between them. The lofted fibers 1203 can be comprise polyester fibers, cotton fleeces, rayon, polyamide, flame resistant fibers, but are not limited thereto. The regions of lofted fibers 1203 are separated from one another via spaces 1204, which comprise encapsulated air regions without any lofted fibers disposed therein. The lofted fibers 1203 extend away from or substantially orthogonal (i.e., in a direction having an orthogonal component) to the solid knit layers 1201 and 1202. The solid knit layers 1201 and 1202 form a denier gradient, in particular implementations. In certain implementations the knit layers 1201 and 1202 have a finer denier than the lofted fibers 1203, which assist with moving the water from one layer 1202, which may be adjacent to a user's skin, to the lofted fibers 1203 and then to the knit layer 1201 without retaining the water or moister in the encapsulated lofted fibers 1203. Alternatively or additionally, the knit layers 1201 and 1202 may have a different denier with respect to one another. In certain implementations, the regions of lofted fibers 1203 are configured in a grid array where spaces separate each region from each other region. As demonstrated in FIG. 12E, one of the knit layers 1201 can have a corrugated, undulated, or other raised profile, while the opposing knit layer 1202 can have a planar or smoother profile. FIGS. 12E and 12F further demonstrate in a cross-section view the spaces 1204 separating the lofted fibers 1203 from one another. In certain implementations, the spaces 1204 may be extended lengthwise and form an air channel running from one end of the fabric to another end of the fabric. As demonstrated in FIGS. 12F and 12G, a braided tube 1205 can be positioned in the elongated space 1204 between the encapsulated lofted fibers 1203. The braided tube 1205 is flexible and stretchable. The braided tube 1205 can include a monofilament, which may be composed at least in part of a material that is distinct from the lofted fibers 1203. The braided tube 1205 illustrated in FIG. 12G can be incorporated into any space illustrated in other embodiments or implementations of the POLARTECπ Power Airπ fabric disclosed herein. In particular embodiments, the braided tube 1205 is composed of nylon fibers. The braided tube 1205 can be composed of other materials in accordance with certain implementations. The braided tube 1205 can be composed of a nylon fiber having a denier in the range of 20-100 denier, in certain implementations. In particular, implementations, the denier of the fiber forming the braided tube 1205 may be greater than 100 denier or less than 20 denier. The braided tube can be composed, at least in part, from a monofilament or a multi-filament. The braided tubing provides permits the fiber to be provided with additional airspace with less weight and may be interspersed with regions of the lofted fibers (e.g., lofted fibers 1203). The braided tubing 1205 provides air space that can increase insulation, yet provide flexibility and elasticity to the fabric to prolong performance, effectiveness, and durability. In certain implementations, the braided tubing 1205 may be positioned between knit layers 1201 and 1202 in a fabric body provided without lofted fibers.

FIGS. 13A-13D illustrate an implementation of the POLARTEC™ Power Air™ fabric with a solid back and an open face and formed with double raschel. A double raschel knit fabric 1300 is illustrated in FIGS. 13A-13D having a first knit layer 1301 comprising a plurality of windows 1306 formed therein. In certain implementations, the windows 1306 may have a constant size across the fabric 1300. In certain implementations, the windows 1306 may have variable size across the fabric 1300. The second knit layer 1302 does not include window inlays. The window inlays 1306 are positioned over the space regions 1304 positioned between the lofted fibers encapsulated in air pockets between the knit layer 1301 and 1302. The window inlays 1306 are positioned in spaces that overlie air spaces between the knit layer 1301 and 1302 rather than being positioned over the lofted fibers 1303. Accordingly, the lofted fibers 1303 are retained encapsulated between the knit layers 1301 and 1302, thereby preventing fiber loss and retaining higher insulating performance levels for extended durations.

While various embodiments show the air/lofted microfiber encapsulation pockets in a rectangular or square grid, various embodiments can include other geometries, which can include constant or varying pocket sizes. For example, the air/fiber encapsulation pockets of lofted fibers may be larger and/or thicker in a certain region of the fabric than in another region.

A number of embodiments of the invention are described above. Nevertheless, it will be understood that various modifications may be made without departing from the spirit and scope of the invention. For example, synthetic materials described above may be employed in industrial products, such as rubber tires, plastics, etc. Accordingly, other embodiments are within the scope of the following claims.

What is claimed is:

1. An insulating, double-knit fabric comprising:

a first knit layer;

a second knit layer coupled with the first knit layer through a plurality of first direction spaced apart rows in a first direction and a plurality of second direction spaced apart rows in a second direction which is perpendicular to the first direction forming a plurality of air pockets in a grid pattern; and a plurality of intermediate fiber regions positioned in the plurality of air pockets, wherein each of the intermediate fiber regions comprise a plurality of rows of multi-filament fibers extending parallel to at least one of the first and second knit layers.

2. The insulating, double-knit fabric of claim 1, wherein the first knit layer comprises first yarns and the second knit layer comprises second yarns, wherein the first knit layer and the second knit layer comprise a denier gradient such that the first yarns have a finer denier than the second yarns or the second yarns have a finer denier than the first yarns.

3. The insulating, double-knit fabric of claim 1, wherein the first knit layer comprises first yarns and the second knit layer comprises second yarns, and wherein the first yarns and the second yarns have a finer denier than the rows of fibers of the plurality of intermediate fiber regions.

4. The insulating, double-knit fabric of claim 1, wherein the plurality of fibers of the intermediate fiber regions comprise a low melt fiber.

5. The insulating, double-knit fabric of claim 1, wherein the plurality of fibers of the intermediate fiber regions comprise at least one of a bi-component filament, a polyester blend, and a polyamide.

6. The insulating, double-knit fabric of claim 5, wherein the bi-component filament comprises modacrylic fiber and cellulosic fiber.

7. The insulating, double-knit fabric of claim 1, wherein the first knit layer and the second knit layer comprise a circular knit.

8. The insulating, double-knit fabric of claim 1, wherein the first knit layer and the second knit layer comprise a double raschel knit.

9. A garment comprising the insulating, double-knit fabric of claim 1.

10. A fabric article comprising the insulating, double-knit fabric of claim 1.

11. The insulating, double-knit fabric of claim 1, wherein the plurality of air pockets have varying sizes in the fabric.

12. The insulating, double-knit fabric of claim 1, wherein the plurality of air pockets have varying thicknesses in the fabric, thickness being defined as the measurement of the air pockets in a direction orthogonal to the first or second knit layer.

13. The insulating, double-knit fabric of claim 1, wherein the fabric contains a first region and a second region and wherein the plurality of air pockets in the first region have a different size than the air pockets in the second region.

14. The insulating, double-knit fabric of claim 1, wherein the first knit layer and the second knit layer comprise a material selected from the group consisting of polyester, polypropylene, nylon, wool, cellulosic fibers, flame resistant fibers, modacrylic fibers, and polyamide fibers.

* * * * *